US012687030B2

(12) United States Patent
De Lange

(10) Patent No.: US 12,687,030 B2
(45) Date of Patent: Jul. 21, 2026

(54) INTERLOCKABLE WALL REINFORCEMENT PANEL, WALL REINFORCEMENT ASSEMBLY AND METHOD FOR WALL REINFORCEMENT

(71) Applicants: B. de Lange Holding B.V., Coevorden (NL); J.van Klinken Holding B.V., Tweede Exloermond (NL)

(72) Inventor: Albertus Johannes De Lange, Coevorden (NL)

(73) Assignees: B. de Lange Holding B.V., Coevorden (NL); J.van Klinken Holding B.V., Tweede Exloermond (NL)

( * ) Notice: Subject to any disclaimer, the term of this patent is extended or adjusted under 35 U.S.C. 154(b) by 149 days.

(21) Appl. No.: 18/562,140

(22) PCT Filed: May 19, 2022

(86) PCT No.: PCT/NL2022/050274
§ 371 (c)(1),
(2) Date: Nov. 17, 2023

(87) PCT Pub. No.: WO2022/245213
PCT Pub. Date: Nov. 24, 2022

(65) Prior Publication Data

US 2024/0229485 A1 Jul. 11, 2024

(30) Foreign Application Priority Data

May 19, 2021 (NL) ..... 2028247

(51) Int. Cl.
*E04F 13/08* (2006.01)
*E04F 15/02* (2006.01)
*E04G 23/02* (2006.01)

(52) U.S. Cl.
CPC ..... *E04G 23/0218* (2013.01); *E04F 13/0889* (2013.01); *E04F 2201/095* (2013.01)

(58) Field of Classification Search
CPC ..... A47G 27/0293; A47G 27/0218; E01C 2201/14; E04G 23/0218; E04G 23/0285;
(Continued)

(56) References Cited

U.S. PATENT DOCUMENTS 1,852,715 A * 4/1932 Greenebaum ..... E04F 13/0862 52/392
3,410,441 A * 11/1968 Rhyne ..... A47B 88/941 312/263

(Continued)

FOREIGN PATENT DOCUMENTS

DE 102013102132 A1 * 9/2014 ..... E04F 13/142
DE 102020119771 A1 * 1/2022 ..... E04F 15/105

(Continued)

*Primary Examiner* — Kyle J. Walraed-Sullivan
(74) *Attorney, Agent, or Firm* — MH2 Technology Law Group, LLP

(57) ABSTRACT

The invention relates to an interlockable wall panel having a wall panel surface extending in a plane defined by a first and a second direction and having side edges, at least one thereof comprising: —indentations extending in the plane and inwardly from the side edge and configured to receive an associated projection of a further interlockable wall panel in a mating and interlocking connection configured to prevent in plane-movement; and/or —projections extending in the plane and outwardly from the side edge and configured to be inserted into an associated indentation of the second or further interlockable wall panel in a mating and interlocking connection configured to prevent in plane-movement; the projections and/or indentations are configured to be connectable to a further interlocking wall panel in a third direction. The invention further relates to wall panel assem- (Continued)

Figure 1A:
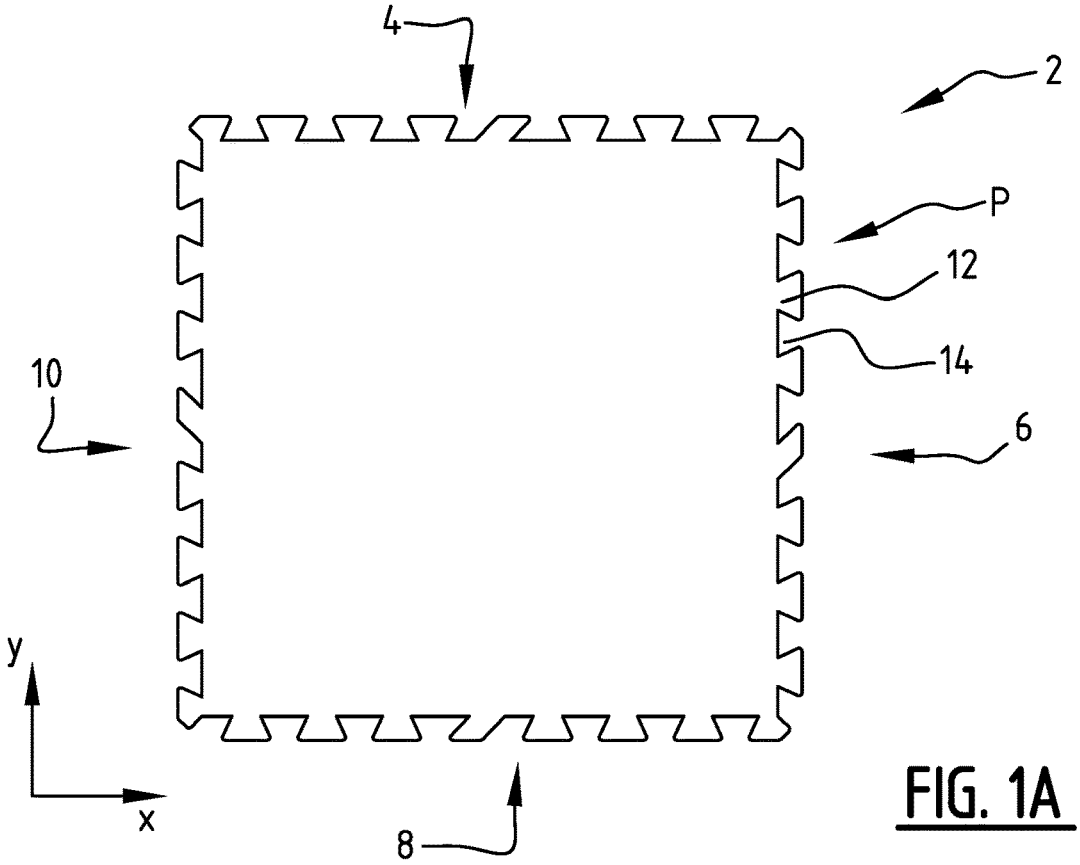

bly, reinforced wall, method for reinforcing a damaged wall and timber frame construction.

10 Claims, 6 Drawing Sheets

(58) Field of Classification Search
CPC ..... E04F 2201/095; E04F 2201/091; E04F 2201/09; E04F 2201/096; E04F 2201/098; E04F 15/02038
See application file for complete search history.

(56) References Cited

U.S. PATENT DOCUMENTS 3,591,212 A * 7/1971 Rhyne ..... B27M 1/02 403/231
3,692,201 A * 9/1972 Garduna ..... B65D 9/34 217/65
3,836,217 A * 9/1974 Shiina ..... A47B 47/0041 403/231
4,173,287 A * 11/1979 Kumakawa ..... B65D 9/12 403/231
5,215,490 A * 6/1993 Szoradi ..... A63H 33/08 446/125
5,357,728 A * 10/1994 Duncanson ..... E04C 2/526 52/592.4
5,746,038 A * 5/1998 Houk ..... E04B 1/02 446/116
6,027,599 A * 2/2000 Wang ..... B44C 5/0446 156/239
6,189,271 B1 * 2/2001 Christensen ..... E04B 2/702 446/106
6,357,194 B1 * 3/2002 Jones, Jr. ..... F16B 12/125 52/592.1
6,453,973 B1 * 9/2002 Russo ..... E04C 3/28 52/592.1
6,782,672 B2 * 8/2004 Staats ..... B32B 3/02 52/272
D768,315 S * 10/2016 Repetto ..... D25/156
11,359,363 B1 * 6/2022 Brotherton ..... E04B 1/02
2003/0131549 A1 * 7/2003 Kappeli ..... B29C 45/14811 52/592.1
2004/0139679 A1 * 7/2004 Della Pepa ..... E04F 15/105 52/592.1
2004/0255540 A1 * 12/2004 Wang ..... E04F 15/10 52/582.1
2006/0127647 A1 * 6/2006 Thrush ..... E04F 15/10 428/172
2007/0199257 A1 * 8/2007 Thrush ..... E04F 15/10 52/180
2011/0000162 A1 * 1/2011 Thrush ..... E04F 15/10 52/588.1
2012/0317911 A1 * 12/2012 Huang ..... E04F 15/02 52/468
2013/0167458 A1 * 7/2013 Cerny ..... E04F 15/10 52/177
2013/0291457 A1 * 11/2013 Tillery ..... E04F 15/105 52/177
2013/0291474 A1 * 11/2013 Tillery ..... A47G 27/0218 29/428
2014/0333022 A1 * 11/2014 Wang ..... E04F 15/02038 273/156
2015/0050448 A1 * 2/2015 Wang ..... A47G 27/0293 428/81
2015/0182056 A1 * 7/2015 Tillery ..... E04F 15/22 52/590.1
2016/0123021 A1 * 5/2016 Cormier ..... E04F 15/22 52/403.1
2018/0001573 A1 * 1/2018 Blomgren ..... B27M 3/04
2019/0284820 A1 * 9/2019 Lu ..... E04F 15/02161
2019/0320793 A1 * 10/2019 Boo ..... F16B 12/125
2019/0323534 A1 * 10/2019 Derelöv ..... A61M 5/1413
2020/0087938 A1 * 3/2020 Fujiwara ..... E04H 9/02
2021/0123252 A1 * 4/2021 Green ..... E04G 23/0218
2022/0049735 A1 * 2/2022 Meijer ..... F16B 12/46

FOREIGN PATENT DOCUMENTS

EP 2894276 A1 * 7/2015 ..... E04F 15/18
EP 2722466 11/2017
GB 1431766 4/1976
JP 2006125069 5/2006
JP 5239190 7/2013

* cited by examiner

INTERLOCKABLE WALL REINFORCEMENT PANEL, WALL REINFORCEMENT ASSEMBLY AND METHOD FOR WALL REINFORCEMENT

The invention relates to an interlockable wall reinforcement panel, a wall reinforcement assembly and a method for wall reinforcement.

It is known from practice that buildings with damaged walls, such as buildings with damage due to seismic events, need to be reinforced or, alternatively, broken down to ensure the safety of its inhabitants or users.

Damaged walls, especially when caused by seismic events, may show one or more different types of damage. A first type of damage is in-plane damage of the wall, which occurs when parts of the wall are displaced with regard to the other parts. This is often visible as cracks or fissures and can occur in brick walls, concrete walls and, in some cases, even in wooden structures such as timber frame constructions.

A second type of damage is the out-of-plane damage, in which parts of the wall structure are displaced transversely to the side surface of the wall. This occurs most often in brick or concrete walls. It is noted that in some cases both types of damage may occur simultaneously in a single wall.

In practice, reinforcement of damaged walls comes down to stabilizing the wall structure in-plane, out-of-plane or both by applying a (rigid) timber frame construction against a side, often the building inner side, of the wall. The timber frame is subsequently covered with wooden boards for support and plaster wall boards to provide a straight inner wall.

Such a timber frame construction for wall reinforcement has several disadvantages. First of all, a timber frame construction has a relatively high thickness due to the posts that constitute the timber frame. As a result, the inner space of the building is decreased after the timber frame has been placed. In addition, many alterations are required to fit window and/or door posts, (plug)sockets and gas pipes to the new situation, which significantly increases costs.

Secondly, the transfer of forces within the stabilizing structure of the wall takes place by transfer from a wall board to a timber frame post and subsequently to the next, adjacent wall board. This results in a high amount of force on the connection means between the different components and requires expensive connections means to withstand these forces.

The invention is aimed at obviating or at least reducing the abovementioned disadvantages.

To that end, the invention provides an interlockable wall panel for reinforcing walls, the panel having a wall panel surface extending in a plane defined by a first and a second direction, the wall surface having a number of side edges, wherein at least one of the number of side edges comprises:

one or more indentations that extend in the plane and inwardly from the side edge, wherein the one or more indentations are configured to receive an associated projection of a second or further interlockable wall panel in a mating and interlocking connection that is configured to substantially prevent in plane-movement; and/or one or more projections that extend in the plane and outwardly from the side edge, wherein the one or more projections are configured to be inserted into an associated indentation of the second or further interlockable wall panel in a mating and interlocking connection that is configured to substantially prevent in plane-movement;

wherein the one or more projections and/or indentations are configured to be connectable to a second or further interlocking wall panel in a third direction.

It is noted that the third direction is substantially perpendicular to the plane and/or to the first and second directions.

It is noted that, in this application, the wording interlockable wall panel for wall reinforcement is used interchangeably with other similar wording, such as interlockable wall reinforcement panel, interlockable wall panel, wall panel and interlockable panel, and in general is directed to the same subject unless specifically noted otherwise.

It is furthermore noted that the words 'reinforcement' and 'reinforcing' are used interchangeably with the words 'stability' and 'stabilizing'. In this application, these words may be considered to relate to a change in the structural integrity of a wall.

It is also noted that the word 'indentation' is used interchangeably with the word 'recess' in this application and these words are considered to have a similar meaning for the purpose of this application.

Similarly, the wording wall panel assembly may also be used interchangeably with the wording interlockable wall panel assembly, interlockable wall reinforcement panel assembly, wall assembly and panel assembly and in general is directed to the same subject unless specifically noted otherwise.

An advantage of the interlockable wall panel according to the invention is that it has a relatively low thickness, when viewed in the third direction (i.e. perpendicular to the wall), thus leading to a relatively small increase in wall thickness after applying the wall panel. As a result, the cost for adapting window and/or door posts and/or (plug)socket connections to the (only slightly) increased wall thickness is significantly less than for existing solutions.

Another advantage of the interlockable wall panel according to the invention is that, due to fact that the wall panel is connectable in the third direction, the wall panel (especially when connected with second and/or further wall panels) provides excellent stability both in-plane (parallel to the wall) and out-of-plane (perpendicular to the wall). As a result, an improved stability (or reinforcement) is achieved compared to known solutions.

Another advantage of the interlockable wall panel according to the invention is that, due to the fact that the interlockable wall reinforcement panel according to the invention is connectable to a second or further wall panel in the third direction, the connection is not subjected to tension, stress or deformations during connecting. Although it would in theory be possible to provide a connection that is established in-plane, this would incur at least some stress and/or deformation in the material and would therewith reduce effectiveness of the wall panel. Because deformation does not occur when connecting the wall panel with a second or further wall panel in the third direction, a connection with improved safety is achieved.

Yet another advantage of the interlockable wall panel according to the invention is that, due to the fact that the interlockable wall reinforcement panel is connectable in the third direction, it provides a seamless fit of the projections and/or indentations between the wall panel and second or further wall panels.

Another advantage of the interlockable wall panel according to the invention is that the wall panel is easy to connect to the wall that is to be reinforced.

Yet another advantage of the interlockable wall panel according to the invention is that the wall panel according to the invention can be manufactured at relatively low cost, and may, for example, be manufactured at a central manufacturing plant.

An even further advantage of the interlockable wall panel according to the invention is that the wall panel can be provided in standardized form, yet may also be provided in custom sizes for specific situations. As a result, the interlockable wall panel provides a flexible device for reinforcement of damaged walls and can be applied in most buildings.

Yet another advantage of the interlockable wall panel according to the invention is that the wall panel may alternatively also be applied to reinforce ceilings and/or floors. To that end, the interlockable wall reinforcement panel may be combined with other interlockable wall reinforcement panels to construct a 'box' of panels that may reinforce both wall(s) and ceiling and/or floor.

In an embodiment of the interlockable wall panel according to the invention, the interlockable wall panel may be manufactured based on a 3D-scan of the wall or walls to be reinforced.

The interlockable wall panels, when manufactured based on a 3D scan of the wall or walls to be reinforced, provide several advantages.

First of all, the interlockable wall panels are manufactured with high amount of precision, especially with regard to the dimensions of the panels required to cover the wall.

Another advantage is that it allows a highly precise positioning of interlockable wall panels that are to be connected across walls that are at an angle with each other.

Yet another advantage of the wall panels being manufactured based on a 3D-scan is that the wall panel or panels can be manufactured using pre-fab techniques. This allows a more efficient manufacturing while simultaneously providing a high-quality, precise fit on the wall that is to be reinforced.

In an embodiment of the interlockable wall panel according to the invention, the wall panel may be combined with a number of standardized components, which increases production and delivery speed and reduces costs.

In an embodiment of the interlockable wall panel according to the invention, the interlockable wall panel is not connectable in-plane, yet only connectable in the third direction, and thus not connectable in the first and/or the second direction.

In an embodiment of the interlockable wall panel according to the invention, the interlockable wall panels are connectable to the wall that is to be reinforced using connections means, which for example may comprise screws, bolt-and-nut connectors or other suitable connection means.

Due to the low thickness of the interlockable wall panels (seen in the third direction), the wall panels can easily be connected to the wall that is to be reinforced. This may for example be provided with screws or bolt-and-nut connections, which provide a reliable and strong connection. Due to the fact that the interlockable wall panel is, in use, situated directly adjacent the wall, the connection means may in principle be applied at any location of the wall panel. This provides a significant improvement over the prior art solutions, which necessitates a connection to the timber frame.

In an embodiment of the interlockable wall panel according to the invention, the one or more projections and/or one or more indentations extend, when measured in a third direction that is perpendicular to the plane, over an entire thickness of the interlockable wall panel.

An advantage of providing the projections and/or indentations of the entire thickness of the interlockable wall panel is that it is easy to connect to adjacent wall panels. Another advantage is that it is easier to manufacture, and therefore more cost-effective.

In an embodiment of the interlockable wall panel according to the invention, the interlockable wall panel may only connectable to the second or further interlockable wall panel in the third direction.

An advantage of providing the connectability only in the third direction, that is, only in a direction substantially transverse to the plane formed by the first and second direction, in-plane movement of the connected interlockable wall panels is substantially prevented. This provides a strong resistance against in-plane movement of the wall that is to be reinforced. Surprisingly, it also provides a strong resistance against out-of-plane movement of the wall to be reinforced.

In an embodiment of the interlockable wall panel according to the invention, the interlockable wall panel may comprise a single layer, or may comprise multiple layers.

An advantage of the interlocking wall panel according to the invention is that it can be provided as a single layer or in multiple layers. In most cases, a single layer in itself already provides sufficient support to a damaged wall without substantially increasing the thickness of said wall.

In some exemplary cases, an even stronger reinforcement needs to be applied to reinforce the damaged wall. In that case, an interlocking wall panel with an increased thickness or multiple layers, often two layers, of interlocking wall panels are applied. This is especially interesting in case the different layers of wall panels are provided with different sizes of interlockable wall panels, which results in the interlocking projections and/or indentations being positioned at different places in the wall after placement.

In an embodiment of the interlockable wall panel according to the invention, the interlockable wall panel may be manufactured from wood, metal, plastic or a combination of one or more thereof, and preferably may be manufactured from wood, wherein the wood preferably comprises multiplex, oriented strand board (OSB), cross-laminated timber (CLT) or glued laminated timber (GLT).

An advantage of providing the abovementioned materials, and especially wood, is that they can easily be manufactured to the required specifications at a central location, such as a manufacturing plant.

In addition, the panels, especially when manufactured of wood, can be manufactured with a high precision with regard to the specifications. This is even more so, when the panels are manufactured based on a 3D scan of the wall to be reinforced.

In an embodiment of the interlockable wall panel according to the invention, a thickness of the interlockable wall panel, when measured in the third direction, may be in the range of 6-30 mm, preferably may be in the range 8-24 mm, and more preferably may be in the range of 12-18 mm.

It has been found that panels, especially wood panels, having a thickness that is at any point in the range between 6-30 mm is usable to reinforce a wall. It has also been found that wall panels, especially when made of wood or plastic, having a thickness in the range of 12-18 mm provide an excellent trade-off between the required reinforcement strength for the wall and the reduction of inner space of the building due to the increase in overall wall thickness.

In addition, in case of wood, it is noted that wood panels for building purposes are often manufactured in standard thicknesses, which include for example 12 mm and 18 mm.

In an embodiment of the interlockable wall panel according to the invention, the connection may be a slidable connection.

In this embodiment, the projection or indentation of the wall panel may be configured to be slidably inserted into an associated indentation or projection of a second or further wall panel. An advantage of sliding the (projections/indentations of the) wall panels together is that it provides a snug fit of the projection in an indentation of a second or further wall panel (or conversely), while at the same time the projections and/or indentations are relatively easy to manufacture.

In an embodiment of the interlockable wall panel according to the invention, the at least one side edge may be provided with a plurality of indentations and projections that are alternately positioned along the side edge.

An advantage of providing a side edge (or multiple side edges) with alternately positioned projections and indentations is that a (semi-)continuous series of projections and indentations is formed that provides a high in-plane and out-of-plane strength to the wall to be reinforced.

Another advantage is that, due to the alternating pattern of projections and indentations, the wall panels can easily be positioned in the correct position with respect to each other before connection them to each other.

In an embodiment of the interlockable wall panel according to the invention, at least two side edges, preferably opposing side edges, of the interlockable wall panel may be provided with one or more indentations and/or one or more projections.

An advantage of providing multiple edges of an interlockable wall panel with one or more projections and/or indentations is that the wall panel can be connected to multiple adjacent wall panels, which provides a completely interlocked series of wall panels that may cover substantially the entire wall. This increased wall stability and improves the reinforcement.

In an embodiment of the interlockable wall panel according to the invention, the interlockable wall panel may substantially be rectangular-shaped or may be substantially square-shaped. Preferably each side edge of the interlockable wall panel may be provided with a plurality of projections and a plurality of indentations that are alternately spaced along the side edge.

Although the interlockable wall panel according to the invention may be provided in substantially any shape, it is preferred to provide it as a rectangular or a square shape.

An advantage of these shapes is that they often match the shape of the wall to be reinforced. In addition, an interlockable wall panel having such abovementioned shape can easily be connected with a mating connection of a second or further panel due to the similar shape.

Another advantage is that rectangular or square interlockable wall panels are easy to transport from a manufacturing site to the place of use.

In an embodiment of the interlockable wall panel according to the invention, the one or more projections may have a T-shaped profile, preferably in which the bottom of the T-shaped projection is connected to the side edge of the interlockable wall panel and extends therefrom.

An advantage of the abovementioned shape is that allows a seamless fit with a corresponding (but oppositely shaped) indentation of a second or further wall panel (according to the invention). As a result of this seamless fit, in-plane movement, that is movement in the first and/or second direction, is substantially prevented and an improved wall stabilization is achieved. Surprisingly, it has been found that this shape also provides an increase of out-of-plane stability to the wall to be reinforced and increases resistance against (further) out-of-plane damage to the wall.

It has been found that the T-shape provides several advantages over other shapes, including but not limited to, rectangular, (isosceles) trapezoid and square shapes.

First of all, it has been found that the failure loads on a (reinforced) wall under stress, including earthquake induced stress, can more easily be calculated when a T-shape is used.

Secondly, it has been found that the T-shape has an improved resistance against disassociation of the connection, especially compared to square and rectangular shapes. This is mainly due to the fact that, when such connections, and especially the square and rectangular connection, are subjected to for example earthquake-induced forces, the connections provide insufficient holding force. This is especially true for sliding forces.

Furthermore, the T-shape has been found to be especially resistant against earthquake induced damage compared to other types of shapes. This is mainly due to the fact that the T-shape provides multiple anti-failure mechanisms.

In an embodiment of the interlockable wall panel according to the invention, the indentations have a T-shaped profile, preferably in which the T-shape extends inwardly from the side edge of the interlockable wall panel, and/or wherein the bottom of the T-shape is positioned at the side edge of the interlockable wall panel.

An advantage of the abovementioned shape is that allows a seamless fit with a corresponding (but oppositely shaped) projection of a second or further wall panel (according to the invention). As a result of this seamless fit, in-plane movement, that is movement in the first and/or second direction, is substantially prevented and an improved wall stabilization is achieved. Surprisingly, it has been found that this shape also provides an increase of out-of-plane stability to the wall to be reinforced and increases resistance against (further) out-of-plane damage to the wall.

Furthermore, the advantages as mentioned above for the T-shaped projection are equally applicable for the T-shaped indentation according to this particular embodiment.

In an embodiment of the interlockable wall panel according to the invention, the indentations may have a trapezium-shaped profile, preferably in which the small base of the trapezium-shape is positioned at the side edge of the interlockable wall panel and the large base is positioned inwardly from the side edge, and more preferably wherein the trapezium-shape is a isosceles trapezium shape.

An advantage of the abovementioned shape is that allows a seamless fit with a corresponding (but oppositely shaped) projection of a second or further wall panel (according to the invention). As a result of this seamless fit, in-plane movement, that is movement in the first and/or second direction, is substantially prevented and an improved wall stabilization is achieved. Surprisingly, it has been found that this shape also provides an increase of out-of-plane stability to the wall to be reinforced and increases resistance against (further) out-of-plane damage to the wall.

In an embodiment of the interlockable wall panel according to the invention, the projections may have a trapezium-shaped profile, preferably in which the small base of the trapezium-shape is positioned at the side edge of the interlockable wall panel and the projections extends outwardly from the side edge, such that the wide base is located at a distance from the side edge, and more preferably wherein the trapezium-shape is a isosceles trapezium shape.

An advantage of the abovementioned shape is that allows a seamless fit with a corresponding (but oppositely shaped)

indentation of a second or further wall panel (according to the invention). As a result of this seamless fit, in-plane movement, that is movement in the first and/or second direction, is substantially prevented and an improved wall stabilization is achieved. Surprisingly, it has been found that this shape also provides an increase of out-of-plane stability to the wall to be reinforced and increases resistance against (further) out-of-plane damage to the wall.

The invention also relates to a wall panel assembly comprising a plurality of interlockable wall panels according to the invention.

The wall panel assembly according to the invention provides similar effects and advantages as the interlockable wall panel according to the invention. The embodiments disclosed above with respect to the interlockable wall panel according to the invention may freely and individually each be combined with the wall panel assembly according to the invention.

In an embodiment of the wall panel assembly according to the invention, the wall panel assembly is configured to cover an entire wall to be reinforced.

It is preferred that the interlockable wall panel assembly covers substantially the entire wall to provide optimal stability.

In an embodiment of the wall panel assembly according to the invention, the interlockable wall panels may be configured to be placed against a single side of a wall that is to be reinforced.

An advantage of connecting the wall panels of the wall panel assembly a single side of the wall that is to be reinforced, is that it provides good wall stabilization, while simultaneously reducing the costs for stabilizing the wall.

In an embodiment of the wall panel assembly according to the invention, the wall panel assembly comprises a first subset of interlockable wall panels that is configured to be connected with a first side wall of a wall that is to be reinforced, and a second subset of interlockable wall panels that is configured to be connected with a second side wall of a wall that is to be reinforced that is opposite the first side wall, such that the first and second subset enclose the wall to be reinforced to form a sandwich structure.

In some cases, a wall may be reinforced by providing a sandwich structure by providing two subsets of interlockable wall panels that are connected to opposite sides of the wall. This provides an even further improved stabilization of the wall to be reinforced/stabilized.

It is noted that it is particularly useful when this embodiment is combined with the embodiment mentioned above, in which the interlockable wall panels are manufactured based on a 3D-scan of the wall (or walls). By two-sided 3D scanning both scan results may be linked to each other to provide a good view of the wall to be reinforced.

In addition, the interlockable wall panels of the first and second subset may, in some cases or at at least at some locations, be connected using the same set of connectors.

Furthermore, it allows an even more accurate detailing of aspects of the wall and/or floor and/or ceiling, such as by the determination of the location of a beam or beams of a floor.

In an embodiment of the wall panel assembly according to the invention, the interlockable wall panels that, in use of the assembly, are connected to each other, are substantially immovable with respect to each other in the first and/or the second direction.

An advantage of the wall panel assembly according to the invention is that is provides a rigid structure that prevents movement in the first and the second direction and therewith obviates (further) in-plane damage of the wall. In addition, the rigidity of the wall panel assembly also prevents out-of-plane movement of the wall, therewith (also) obviating further out-of-plane damage to the wall.

In an embodiment of the wall panel assembly according to the invention, the assembly comprises a support subset of interlockable wall panels that is configured to be connected to a ceiling or floor that is to be reinforced, wherein the interlockable wall panels of the support subset have a side edge comprising one or more indentations and/or projections that are shaped to providing a mating and interlocking connection with an interlockable wall panel that extends substantially perpendicular to the plane of an interlockable wall panel of the support subset, wherein the mating and interlocking connection is configured to substantially prevent in plane-movement with respect to the substantially perpendicularly extending wall panel.

An advantage of additionally providing a support subset is that a 'box-like' structure can be created that stabilizes walls and ceilings and/or floors of a building. The use of a box-like structure provides an even higher stabilization to the building (including walls, ceiling and/or floor) due to the increased rigidity of the entire assembly.

Another advantage is that a seamless transition of forces is achieved between the walls on the one hand and the ceiling and/or floor on the other hand.

The invention also relates to a reinforced wall of a building comprising:

- a wall of a building, preferably a damaged wall, having two substantially planar side surfaces and a thickness that is measured between the planar side surfaces; and
- a plurality of interlockable wall panels according to the invention, that is connected to a planar side surface of the wall, and is interlocked with each other,
- wherein each of the plurality of interlockable wall panels is interlocked which at least one adjacent interlockable wall panel of the plurality of interlockable wall panels.

It is noted that the wall thickness is measured between side surfaces and generally is less than a length and/or width of the planar side surfaces.

It is further noted that the reinforced wall may also comprise a wall panel assembly according to the invention (instead of a plurality of wall panels according to the invention).

The reinforced or stabilized wall according to the invention provides all effects and advantages as mentioned for the interlockable wall panel and/or the wall panel assembly according to the invention. The reinforced or stabilized wall according to the invention may therefore freely be combined with embodiments, together or individually, as described for the interlockable wall panel according to the invention.

An advantage of the reinforced wall according to the invention is that, due to the fact that the plurality of wall panels is connected to each other in an interlocking manner and connected to the wall of the building, the wall is provided with an improved stability and therewith has an increased resistance against future (seismic) damage.

Another advantage of the reinforced wall according to the invention is that the unity check of the wall is below 1.0, and often is below 0.8, and can even be below 0.6. The unity check is a ratio between the maximum stress on a wall (before breaking/collapsing) compared with the stress induced by external forces, such as earthquakes. The maximum stress is indicated with for example 10, whereas the actual stress is measured and, in acceptable cases, be below 10 to provide a ratio below 1.0.

In an embodiment of the reinforced wall according to the invention, the plurality of interlockable wall panels may cover substantially the entire planar side surface of the wall to be reinforced.

It is preferred that the interlockable wall panels cover substantially the entire wall to provide optimal stability.

In an embodiment of the reinforced wall according to the invention, the plurality of interlockable wall panels may comprise a first set of interlockable wall panels that is connected to a first planar side surface of the wall, and a second set of interlockable panels that is connected to a second planar side surface of the wall that is opposite the first planar side surface.

It is preferred in this embodiment that both the first and the second set cover substantially the entire planar side surface of the wall to be reinforced.

By providing the wall with two subsets of interlockable wall panels on adjacent side surfaces, an even higher stability of the wall is achieved.

The invention also relates to a building stabilization assembly, the assembly comprising a plurality of subsets of interlockable wall panels according to the invention, the plurality comprising:

at least one wall subset of interlockable wall panels, wherein each of the at least one subsets is configured to be associated with and connected to a side wall of a building that is to be reinforced;

a floor subset that is configured to be connected to a floor of the building that is to be reinforced, wherein the interlockable wall panels of the floor subset have a side edge comprising one or more indentations and/or projections that are shaped to provide a mating and interlocking connection with one or more interlockable wall panels of the at least one wall subset; and/or a ceiling subset that is configured to be connected to a ceiling of the building that is to be reinforced, wherein the interlockable wall panels of the ceiling subset have a side edge comprising one or more indentations and/or projections that are shaped to provide a mating and interlocking connection with one or more interlockable wall panels of the at least one wall subset.

An advantage of building stabilization assembly is that a 'box-like' structure is created, which secures a building against earthquake damage. This is mainly due to the fact that horizontal forces, especially those induced by earthquakes, are transferred via the floor or ceiling subset to the wall subset or wall subsets and subsequently to the foundation of the building. Therewith, the stabilization assembly is capable of effectively and efficiently mitigating forces (i.e. stress) on the building to the foundation.

Another advantage of the stabilization assembly is that it provides an increased rigidity by connecting the at least one wall subset with the floor or ceiling subset. It is preferred that multiple walls are covered with a wall subset, which is connected to the floor or ceiling subset, since each additional wall that is covered with wall panels and connected to a floor or ceiling subset further increases stabilizing effect.

Another advantage is that a seamless transition of forces is achieved between the walls on the one hand and the ceiling and/or floor on the other hand.

Another advantage is that the mating and interlocking connection is configured to substantially prevent in plane-movement (of the floor or ceiling) with respect to the wall panels, which preferably extend substantially perpendicularly to the floor or ceiling panels.

The invention also relates to a method for reinforcing a damaged wall, the method comprising:

providing a plurality of interlockable wall panels according to the invention, or a wall panel assembly according to the invention;

connecting the plurality of interlockable wall panels to the wall to be reinforced and to each other.

The method according to the invention provides similar effects and advantages as the interlockable wall panel, the wall panel assembly and the reinforced wall according to the invention. The embodiments disclosed above with respect to the interlockable wall panel according to the invention may freely and individually each be combined with the method according to the invention.

In an embodiment of the method according to the invention, the step of connecting the plurality of interlockable wall panels to the wall to be reinforced and to each other, comprises:

placing the plurality of interlockable wall panels against the wall to be reinforced;

during placing, interlocking adjacent interlockable wall panels to each other; and fixating the plurality of interlockable wall panels to the wall using connection means.

An advantage of positioning, placing and interlocking the interlockable wall panels with respect to each other before fixating them to the wall is that the step of interlocking can be performed in the third direction (i.e. perpendicular to the wall).

The invention also relates to a reinforcement construction kit for reinforcing a damaged wall, the construction kit comprising:

a plurality of wall panels according to the invention, or an assembly according to the invention; and connection means adapted for fixating the interlockable wall panels to a wall.

The reinforcement construction kit according to the invention provides similar effects and advantages as the interlockable wall panel, the wall panel assembly, the reinforced wall and the method according to the invention. The embodiments disclosed above with respect to the interlockable wall panel according to the invention may freely and individually each be combined with the method according to the invention.

It is noted that the interlockable wall panel according to the invention can, in addition to reinforcing or stabilizing, also be used in the construction of new (undamaged) buildings with timber frame construction.

The invention therefore also relates to a timber frame construction comprising:

a timber frame;

a plurality of interlockable wall panels according to the invention that are connected to the timber frame; and optionally, plaster boards that are connected to the interlockable wall panels at a side that is opposite from the side to which the timer frame is connected.

An advantage of the timber frame construction according to the invention is that it provides increased stiffness compared to traditional timber frame constructions due to the interlockable wall panels according to the invention.

As a result, a timber frame construction according to the invention has an increased resistance against both in-plane and out-of-plane forces acting on the construction. This is, in part, due to the fact that the forces are not only transferred via the connection means that connect the panels to the timber frame, but also via the connection between the interlocking, mating parts of the interlockable wall panels according to the invention.

The timber frame construction according to the invention provides similar effects and advantages as the interlockable wall panel and the wall panel assembly according to the invention. The embodiments disclosed above with respect to the interlockable wall panel according to the invention may freely and individually each be combined with the timber frame construction according to the invention.

In an embodiment of the timber frame construction according to the invention, the timber frame construction may additionally comprises one or more of: isolation material that is positioned between posts of the timber frame, an isolation layer that is positioned on a side of the interlockable wall panels that is opposite the side that is connected to the timber frame, or a moisture reduction layer.

Figure 1B:
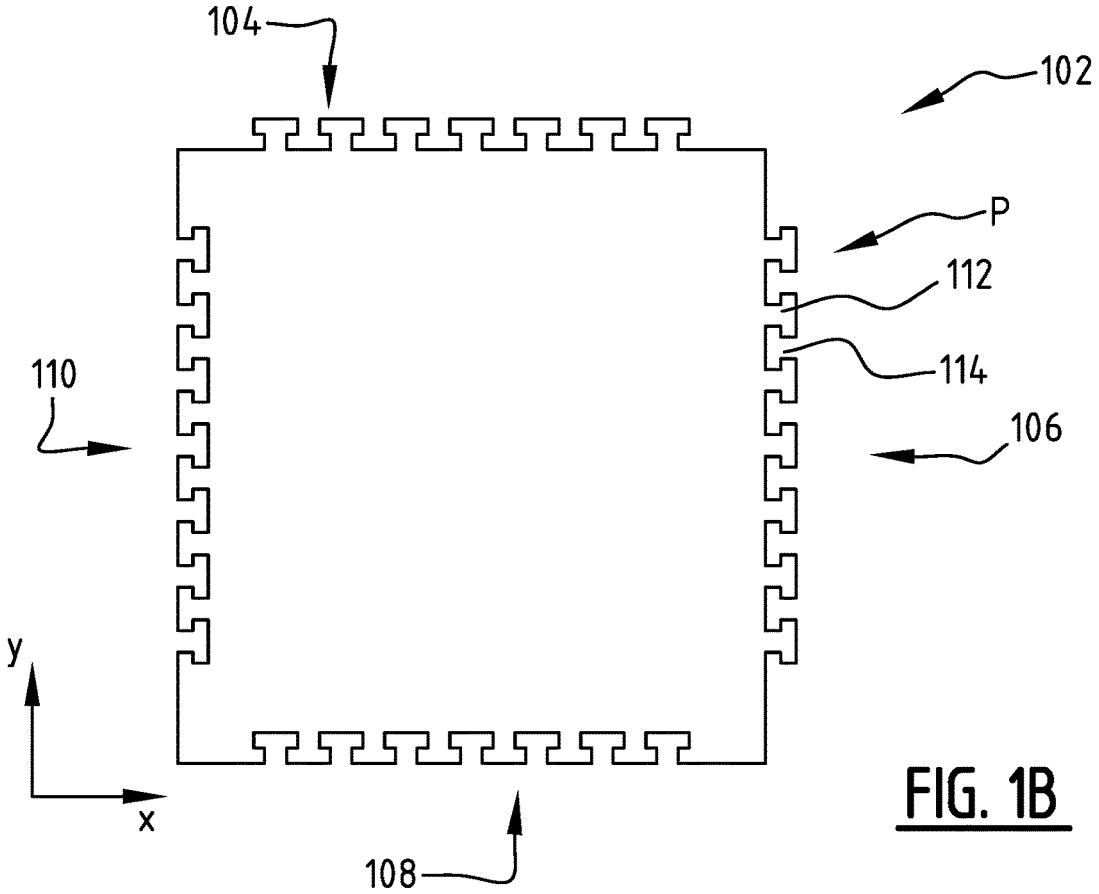
Figure 2A:
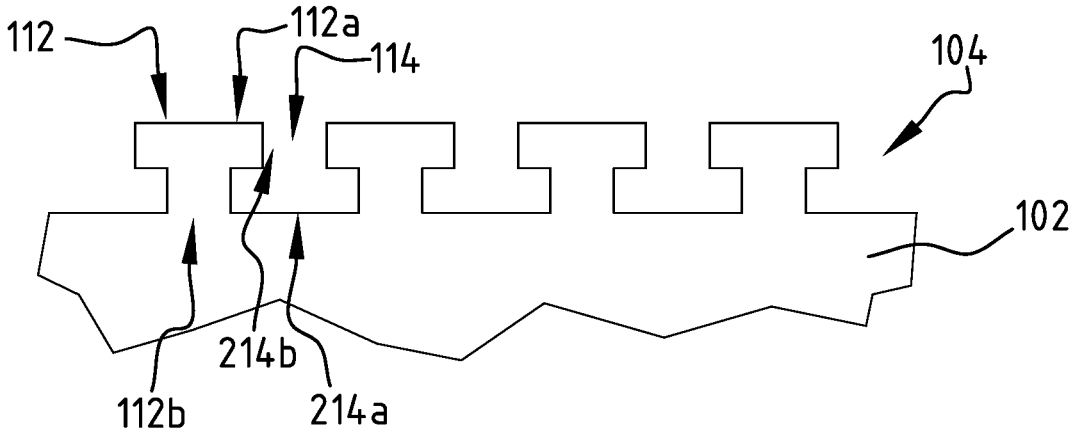
Figure 2B:
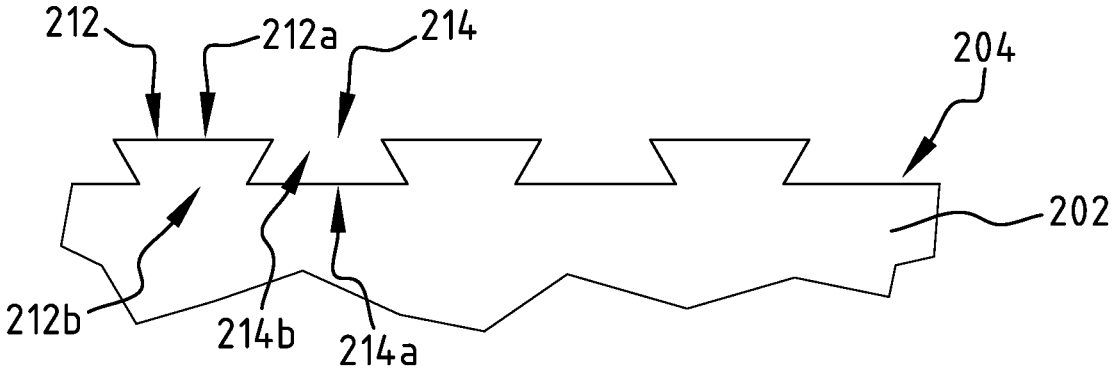
Figure 3A:
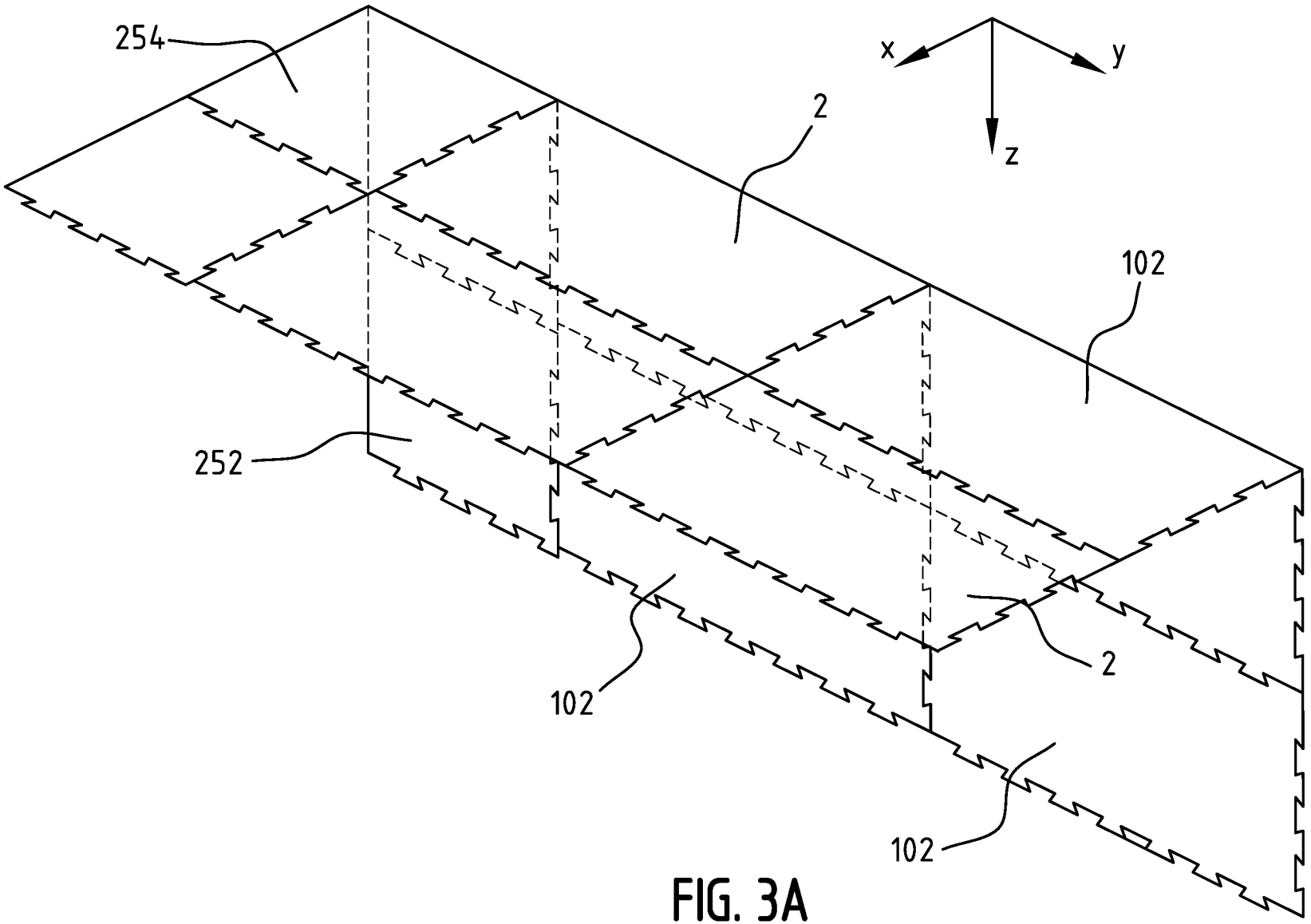
Figure 3B:
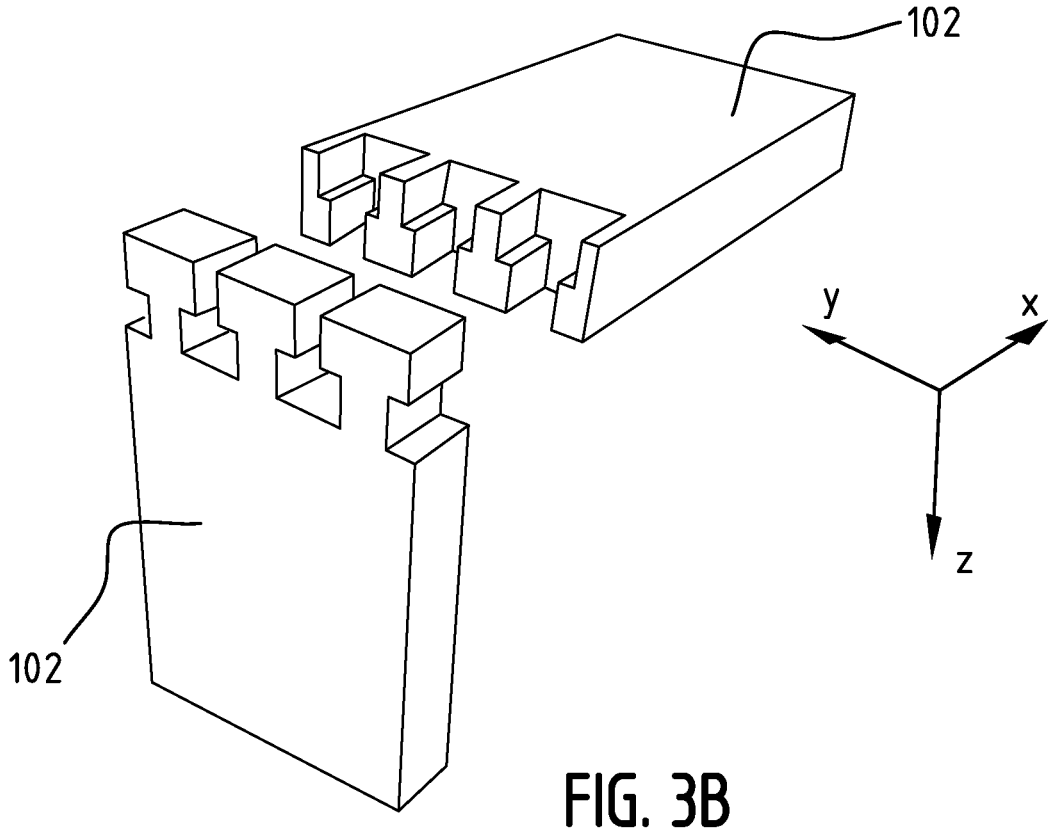
Figure 3C:
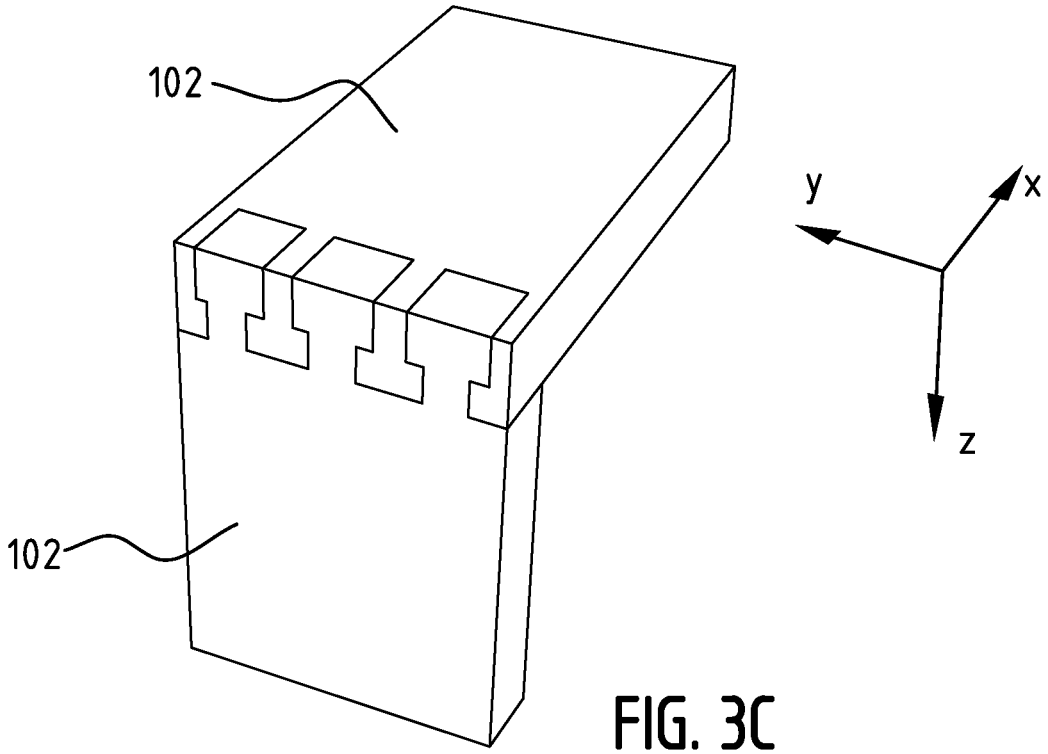
Figure 4:
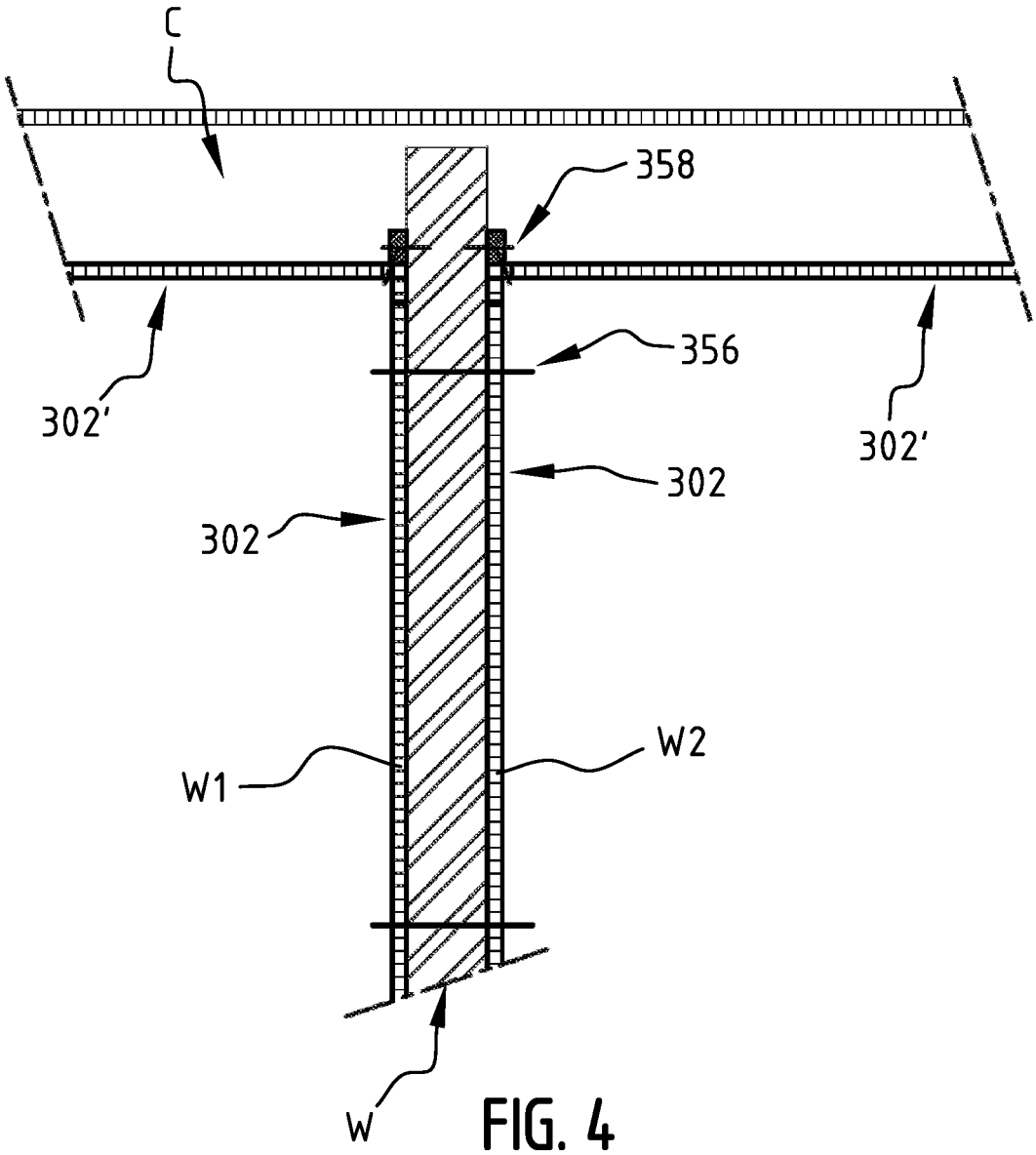
Figure 5:
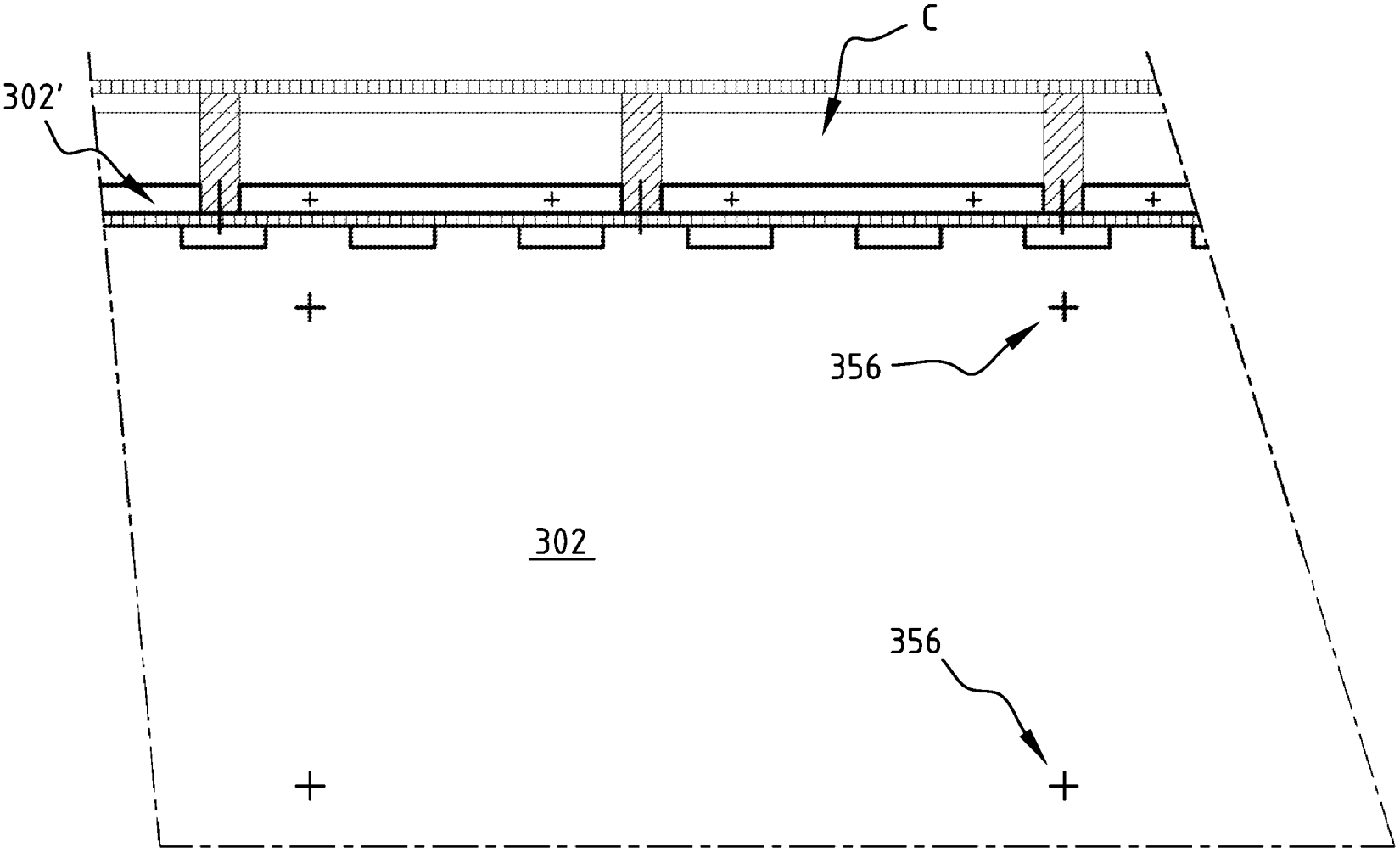

Further advantages, features and details of the invention are elucidated on the basis of preferred embodiments thereof, wherein reference is made to the accompanying drawings, in which:

FIGS. 1*a* and 1*b* show examples of interlockable wall panels according to the invention;

FIGS. 2*a* and 2*b* show detailed views of examples of projections and/or indentations of an interlockable wall panel according to the invention;

FIGS. 3*a*, 3*b* and 3*c* show examples of a wall panel assembly according to the invention;

FIG. 4 shows a schematic cross-section of a wall that is reinforced using a wall panel assembly according to the invention; and FIG. 5 shows a schematic side view of FIG. 4.

In an example (see FIG. 1*a*, 1*b*), interlockable wall panel 2, 102 is a wood board, such as an OSB-board or a multiplex board, that extends in a plane defined by first direction x and second direction y. Each side edge 4, 6, 8, 10, 104, 106, 108, 110 of interlockable wall panel 2 is provided with an alternating pattern P of projections 12, 112 and indentations 14, 114. It is noted that the presence of either projections 12, 112 or indentations 14, 114 on side edge 4, 6, 8, 10, 104, 106, 108, 110 automatically incurs the presence of the other of projections 12 and indentations 14, 114. It is noted that FIG. 1*a* shows trapezoid projections 12, 112 and indentations 14, 114, whereas in FIG. 1*b* the interlockable wall panel 2, 102 is provided with T-shaped projections 12, 112 and indentations 14, 114.

In more detail (see FIGS. 2*a*, 2*b*), it is shown that projections 112, 212 and indentations 114, 214 can have different shapes to achieve the interlocking effect between interlockable wall panel 102 and second or further interlockable wall panels (not shown).

In a first example, projection 112 has a T-shape, with bottom end 112*b* of the T being connected side edge 104 of interlockable wall panel 102 and upper end 112*a* projecting from side edge 104. Due to the shape of projection 112, indentation 114 is automatically provided with an inverted T-shape, in which bottom end 114*b* points upward in the second direction y and bottom end 114*a* is positioned at side edge 104. This alternating pattern allows interlockable wall panel 102 to be connected to a second or further interlockable wall panel in the third direction z (not shown) and substantially prevents any movement in the plane formed by first direction x and second direction y.

In a second example (see FIG. 2*b*), projection 212 has a trapezium shape in which small base 212*b* is located at side edge 204 and is connected therewith. Large or wide base 212*a* is located at some distance outwardly from side edge 204. Indentation 214 has a mirrored position compared to projection 212. This means that small base 214*b* in this example is located upwardly from side edge 204, whereas wide or large base 214*a* is formed at side edge 204.

In an example of wall panel assembly 250 (see FIGS. 3*a* and 3*b*), wall panel assembly 250 comprises a plurality of interlockable wall panels 2, 102 that are interlocked with each other. Also shown are wall panel 254, having two 'flat' side edges and two side edges comprising an alternating pattern of projections and indentations, and wall panel 252, which is provided with one 'flat' side edge and three side edges comprising an alternating pattern of projections and indentations. Wall panel assembly 252 can easily be connected to a (not shown) wall to stabilize that wall. FIGS. 3*a* and 3*b* show wall panel assembly 250 having projections and indentations in respectively trapezoid shape (FIG. 3*a*) and T-shape (FIG. 3*b*).

In an example of reinforced wall W (see FIGS. 4 and 5), wall W is reinforced or stabilized using (a plurality of) interlockable wall panels 302 that in this example are positioned on opposite sides W1, W2 of wall W. Interlockable wall panels 302 are in this example connected to wall W using connection means 356, which may for example be a bolt and nut connection. Similarly, ceiling C in this example is stabilized using interlockable wall panels 302'. The connection between interlockable wall panels 302 and interlockable wall panels 302' is in this case enhanced using connection beam 358. This connection beam 358 is however not necessary to achieve the stabilization.

The present invention is by no means limited to the above described preferred embodiments thereof. The rights sought are defined by the following claims within the scope of which many modifications can be envisaged.

The invention claimed is:

1. A building stabilization assembly comprising a plurality of subsets of interlockable panels, the plurality of subsets of interlockable panels comprising:

at least one wall subset of interlockable panels, wherein each of the interlockable panels is configured to be associated with and connected to a side wall of a building that is to be reinforced; and at least one of the following:

a floor subset of interlockable panels that is configured to be connected to a floor of the building that is to be reinforced, wherein each of the interlockable panels of the floor subset have a side edge comprising one or more indentations and/or projections that are shaped to provide a mating and interlocking connection with one or more interlockable panels of the at least one wall subset; and/or a ceiling subset of interlockable panels that is configured to be connected to a ceiling of the building that is to be reinforced, wherein each of the interlockable panels of the ceiling subset have a side edge comprising one or more indentations and/or projections that are shaped to provide a mating and interlocking connection with one or more interlockable panels of the at least one wall subset, wherein each of the subsets of interlockable panels are for reinforcing walls, a ceiling, or a floor, and each interlockable panel having a panel surface extending in a plane defined by a first and a second direction, the interlockable panel surface having a number of side edges, wherein at least one of the number of side edges comprises:

one or more indentations that extend in the plane and inwardly from the at least one side edge, wherein the one or more indentations are configured to receive an associated projection of a second or further interlockable panel in a mating and interlocking connection that is configured to substantially prevent in plane-movement; and/or one or more projections that extend in the plane and outwardly from the at least one side edge, wherein the one or more projections are configured to be inserted into an associated indentation of the second or further interlockable panel in a mating and interlocking connection that is configured to substantially prevent in plane-movement, wherein the one or more projections and/or indentations are configured to be connectable to a second or further interlocking panel, and wherein each interlockable panel within each subset of interlockable panels is only connectable to the second or further interlockable panel within that same subset of interlockable panels in a third direction.

2. The building stabilization assembly according to claim 1, wherein the at least one wall subset, the ceiling subset, and the floor subset of interlockable panels, when in an assembled position, provide at least a floor panel, a panel, and a ceiling panel to be reinforced.

3. The building stabilization assembly of claim 1, wherein each interlockable panel comprises a single layer, or wherein each interlockable panel comprises multiple layers.

4. The building stabilization assembly of claim 1, wherein each interlockable panel is manufactured from wood, wherein the wood comprises, oriented strand board (OSB), cross-laminated timber (CLT) or glued laminated timber (GLT), and comprises multiplex.

5. The building stabilization assembly of claim 1, wherein a thickness of each interlockable panel, when measured in the third direction, is in the range of 6-30 mm.

6. The building stabilization assembly of claim 1, wherein the mating and interlocking connection is a slidable connection.

7. The building stabilization assembly of claim 1, wherein the at least one side edge is provided with a plurality of indentations and projections that are alternately positioned along the side edge.

8. The building stabilization assembly of claim 1, wherein at least two side edges of each of the interlockable panels are provided with one or more indentations and/or one or more projections.

9. The building stabilization assembly of claim 1, wherein each of the interlockable panels is rectangular-shaped or substantially square-shaped, and wherein each side edge of each of the interlockable panels is provided with a plurality of projections and a plurality of indentations that are alternately spaced along each of the side edges.

10. The building stabilization assembly of claim 1, wherein the one or more projections have a T-shaped profile, in which a bottom of the T-shaped profile of the one or more projections is connected to the at least one side edge of each interlockable panel and extends therefrom; and/or wherein the one or more indentations have a T-shaped profile, in which a bottom of the T-shaped projection is positioned at the at least one side edge of each interlockable panel and the T-shape extends inwardly into the panel.

* * * * *